US006043750A

United States Patent [19]

Mallory

[11] Patent Number: 6,043,750

[45] Date of Patent: Mar. 28, 2000

[54] TALKING SMOKE DETECTOR

[76] Inventor: Mitchell Keith Mallory, 314 SW. 2nd St., Richmond, Ind. 47374

[21] Appl. No.: 09/153,973

[22] Filed: Sep. 16, 1998

[51] Int. Cl.[7] ..... G08B 23/00

[52] U.S. Cl. ..... 340/693.8; 340/628; 340/692; 340/693.11

[58] Field of Search ..... 340/693.5, 693.8, 340/693.9, 693.11, 692, 628; 446/297, 397

[56] References Cited

U.S. PATENT DOCUMENTS 4,896,145 1/1990 Lewkowicz ..... 340/628 X
4,904,988 2/1990 Nesbit et al. ..... 340/628
4,954,816 9/1990 Mattison ..... 340/628 X
5,011,449 4/1991 Handy et al. ..... 446/297
5,726,629 3/1998 Yu ..... 340/692 X

*Primary Examiner*—Thomas Mullen
*Attorney, Agent, or Firm*—Herman Hohauser

[57] ABSTRACT

An angle measurement tool having several components that are assembled to form two moving parts wherein one of the parts is a straight edged member combined with angle measurement means and the other is a straight edged member with both straight edge members sharing a common pivot axis with the angle measurement means and simultaneously providing readings of the miter joint angle, the actual angle formed by the legs, the complementary angle of the actual angle and the supplementary angle of the actual angle.

3 Claims, 5 Drawing Sheets

TALKING SMOKE DETECTOR

BACKGROUND

The subject invention is designed to be used in conjunction with a pre-existing standard light fixture found in many residences. It is known that such lighting fixtures can include a coupling structure to which other devices can be attached. Generally, these pre-existing light fixtures are located on the ceiling of the room that it is intended to be used and more particularly, in the geographic center of the ceiling of that room.

Smoke detectors are known as providing an important safety feature in homes and apartment dwellings. Some governmental agencies require the installation of smoke detectors. Some people do not like the looks of a smoke detector and would rather not have one. Retailers have sought unique designs for smoke detectors. Many alternative designs of smoke detectors are known in the art. For example, the placement of a smoke detector in the body of a toy, is exemplified by the disclosure in U.S. Pat. No. 4,904,988 which involves a portable unit not easily placed near the ceiling of the room in which it is to be used.

OBJECT OF THE INVENTION

It is the object of this invention to utilize a pre-existing light fixture to mount a specially constructed and pleasingly designed smoke detector having novel and decorative features for the increased enjoyment and safety of the inhabitants of the room.

It is a further object of the invention to provide a smoke detector that has its own power supply and mounting capabilities combined into the design of a toy doll so that it can be easily and inexpensively attached to an existing residential ceiling-mounted light fixture.

It is still a further object of this invention to provide a smoke detector having a coupling mechanism that is uniquely designed to actuate a voice circuit board.

SUMMARY OF THE INVENTION

The present invention is directed to a smoke detector that is placed inside the body of a toy doll. The toy doll is permanently mounted upon a support structure that resembles a child's swing. The swing shaped support structure is removably attached to the light fixture normally found at the geographic center of the ceiling of a room in a residential setting of a home or an apartment.

A circuit board housed in the toy body that can replicate the sound of a human voice is connected to a speaker that is also housed on the doll. An electric switch is provided so that when the doll and the swing is moved, the switch activates the voice circuit board that has contained therein several distinct one or more word messages. In the preferred embodiment a plurality of messages will be contained in the circuit board. Every time the switch is activated a succeeding message will play. Once all the messages are played the first one will again play upon the activation of the switch.

An indicator light is included and in the preferred embodiment is located on the wrist of the toy doll. Various attachments to the indicator light is provided for variety and design. In the preferred embodiment the attachment is in the shape of a butterfly. The attachment is removable so that a different shaped article can be attached.

All of the electrical components including the smoke detector, voice circuit board and indicator light are powered by a battery that is housed in the body of the toy doll.

DETAILED EXPLANATION OF INVENTION

Figure 1:
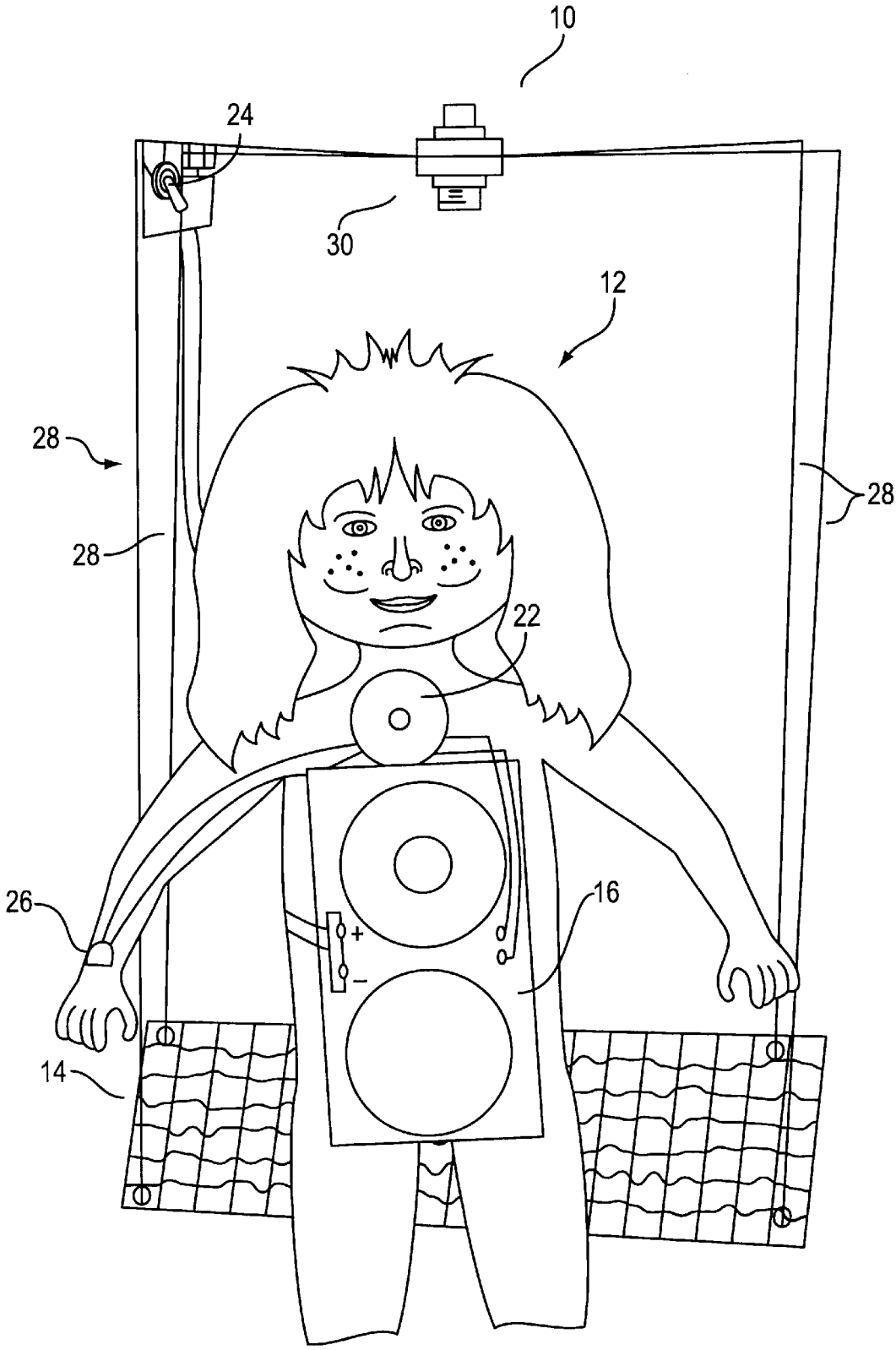
FIG. 1 is a perspective front view of the present invention.
Figure 2:
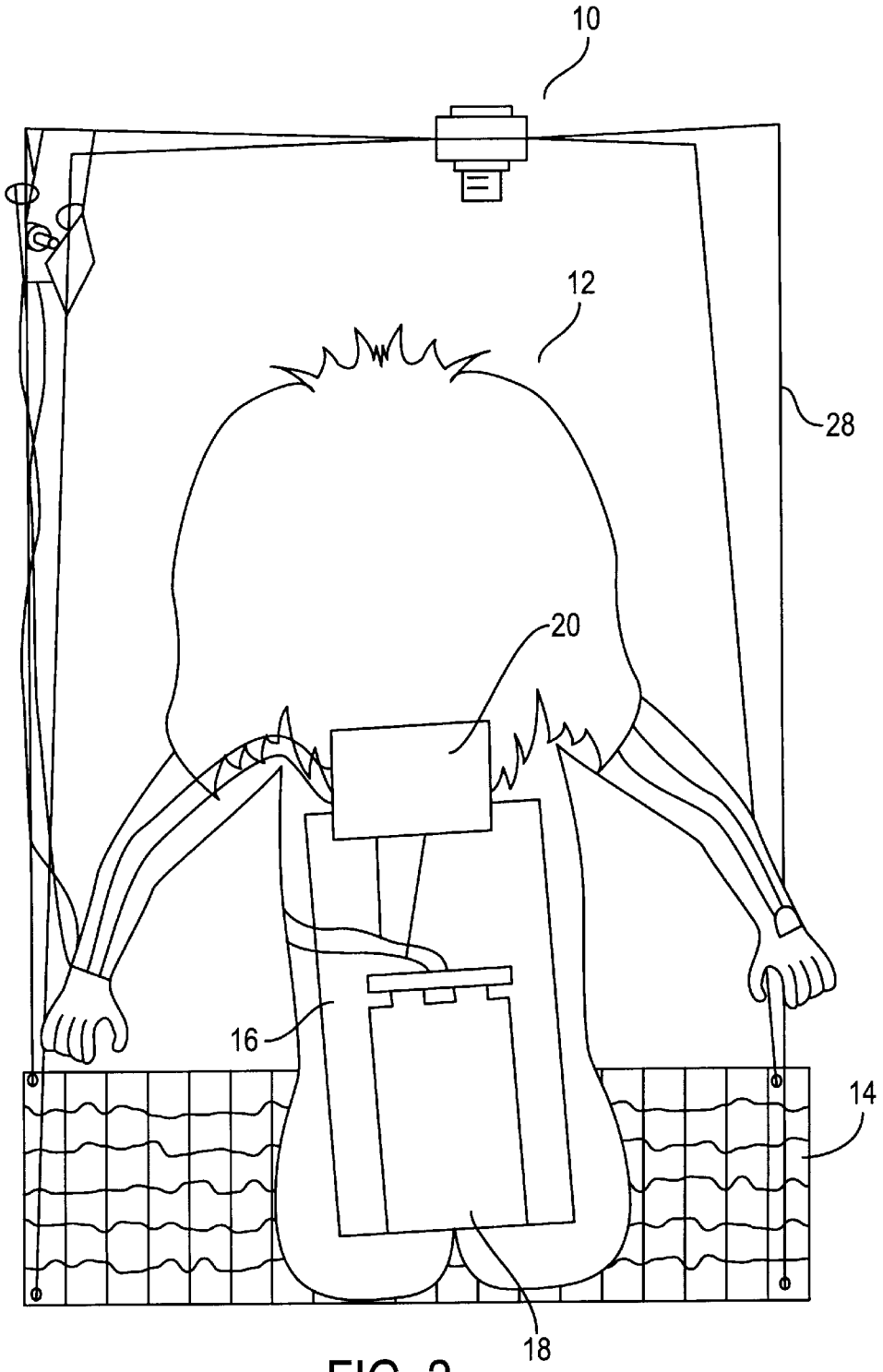
FIG. 2 is a perspective of the back view of the present invention.
Figure 5:
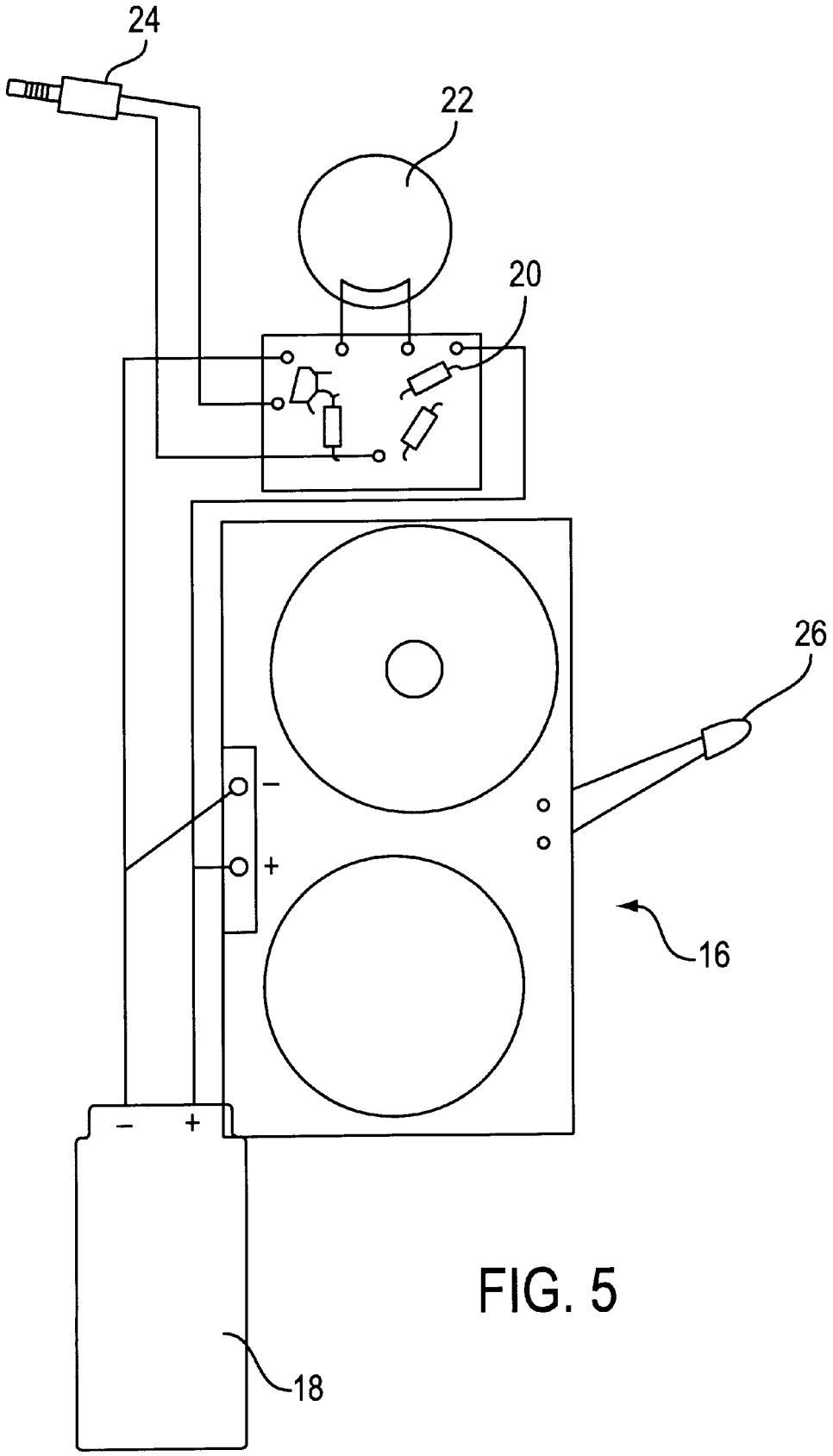
FIG. 5 is a schematic view of the operational components of the present invention illustrating the electrical circuit connections thereof.

Referring to FIG. 1 the talking doll smoke detector 10 is seen to include a molded doll 12. The actual structure of the doll forms no part of this invention and can be any doll or toy model without affecting the scope of the invention. Doll 12 is located in a sitting position on swing seat 14. Smoke detector 16 is permanently attached to the body of the doll as shown in FIG. 1 and FIG. 2 and is powered by battery 18 in a manner well known in the art. Voice circuit board 20 is located on the body of the doll and electrically connected to the battery as shown in FIG. 5. Speaker 22 is also located on the body of the doll electrically connected to voice circuit board 20.

Figure 3:
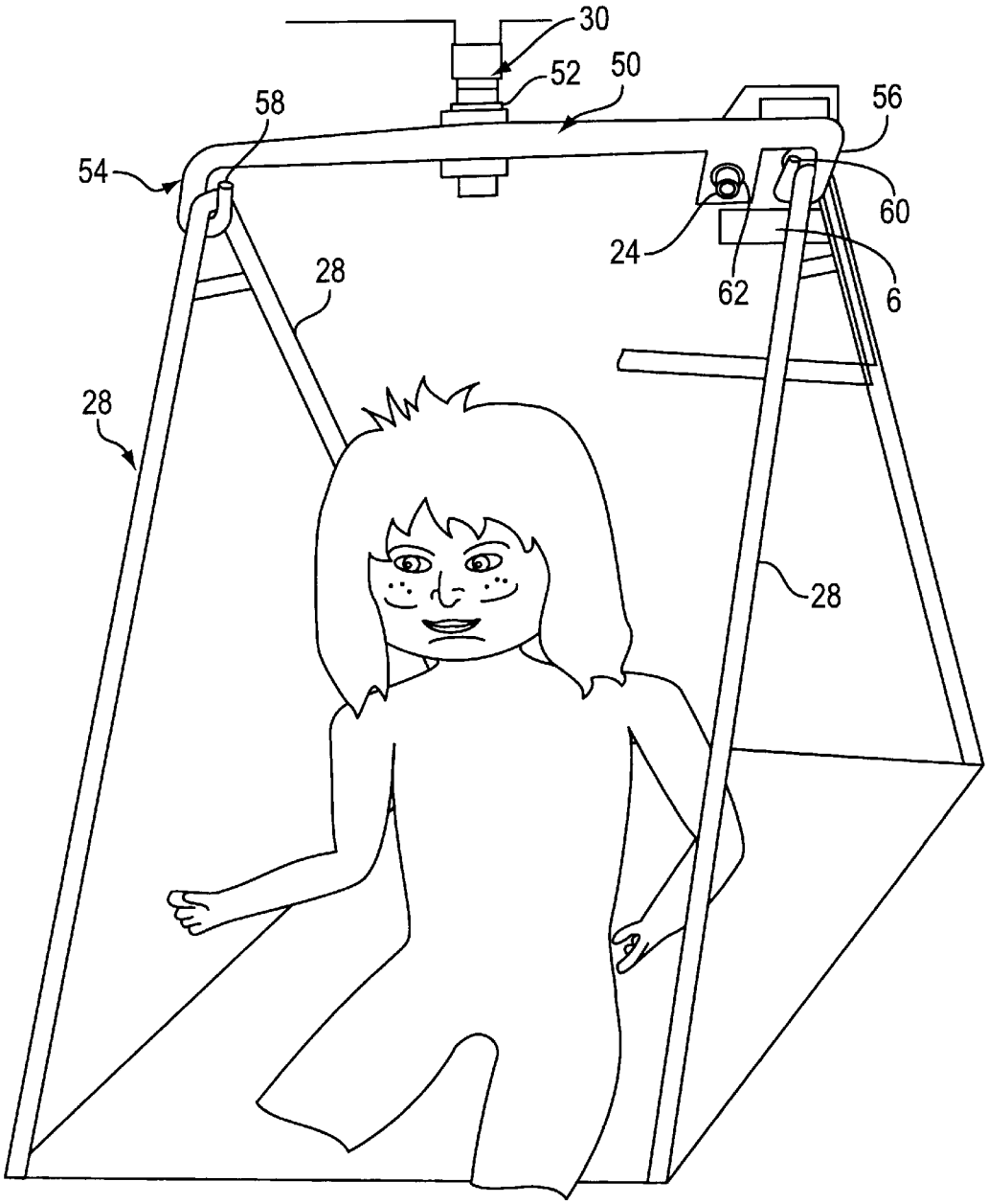
FIG. 3 is a perspective view of the swing support of the present invention.
Figure 4:
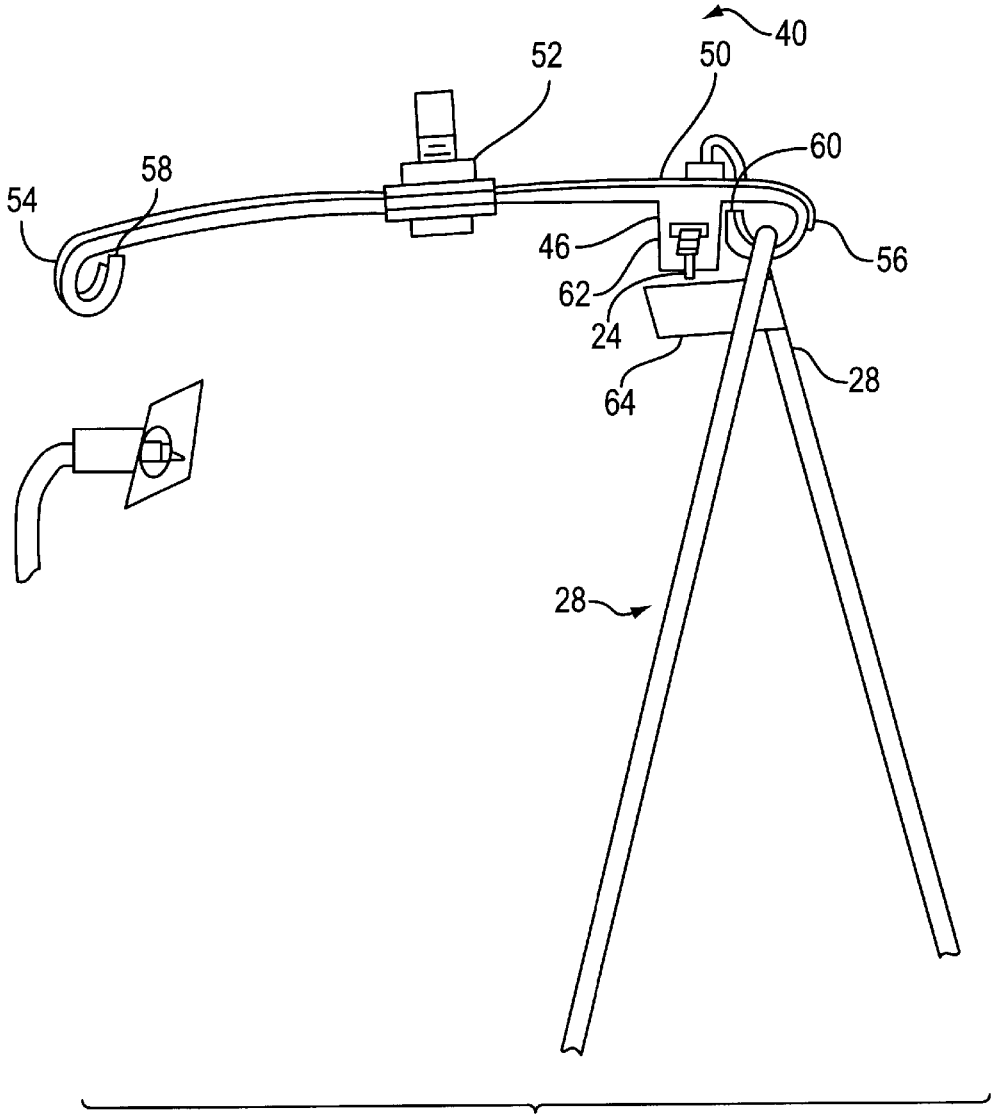
FIG. 4 is a perspective view of the upper portion of the swing support of the present invention.

Referring to FIGS. 3 and 4 it can be seen that the actuation of the voice circuit is controlled by switch 24 which in the preferred embodiment is a push button switch. As explained below in greater detail, switch 24 is actuated by the swinging action of the swing 14 and toy doll 12.

FIG. 1 shows indicating light 26 is provided to indicate the electrical condition of the battery. When the stored power of the battery is below a predetermined value the indicator light 26 is automatically turned on. In the preferred embodiment indicator light 26 is located on the wrist of doll 12 as shown and is in the shape of a wrist watch. In alternative embodiments different shaped attachments, such as that of a butterfly can be added to the indicator light for diversification and amusement purposes.

Extending in an upward direction from each corner of seat 14 are four swing support bars 28. There are therefore four support bars, each designated 28 in the drawings. In the preferred embodiment the four support bars 28 are formed from two bars that are bent in the middle so that they can be supported as will be explained below.

Referring to FIG. 3 it can be seen that mechanism 30 is a hardware accessory used to connect electrical devices such as a fan to lighting fixtures normally found in residences.

A unique mounting structure 50 is provided with member 52 which is attachable to mechanism 30 as is well known in the art. Located at each end of mounting structure 50 are U-shaped portions 54 and 56. Portion 54 has end 58 and portion 56 has end 60. Ends 58 and 60 are positioned under the main structure of member 50 in a manner, as best seen in FIG. 3 to allow the placement of support bars 28 in a position so that they rest in the hook like area formed for that purpose.

Also included as part of the mounting structure 50 is portion 62 upon which push button 24 is mounted. Stop plate 64 is located on one of the support bars 28 as shown in FIGS. 3 and 4.

In operation, as doll 12 sitting on swing 14 is pushed, swing 14 along with support bars 28 is moved so that stop plate 64 engages push button 24. The actuation of push button 24 causes the operation of voice circuit board 20. Every time voice circuit board is actuated a short message is sounded. If there is a plurality of recorded messages each will be played per actuation. After all the messages have been heard the first message will play the next time push button 24 is operated.

In the preferred embodiment smoke detector 16 is a readily available off-the shelf item and operates in the standard and well-known manner.

While the smoke detector doll has been described in particular detail, it should be appreciated that the present invention should not be limited by such detail, but rather construed in accordance with the below claims.

What is claimed is:

1. A smoke detection apparatus comprising a moveable platform, support means to connect said platform to an electrical light fixture, a toy doll positioned on said platform, a smoke detector located on the body of said toy doll, electrical storage means connected to said smoke detector, and a recorded message delivery means connected to said doll that is actuated upon a predetermined movement of said platform.

2. The apparatus of claim 1 wherein an indicating light attached to said toy doll signifies when said electrical storage means is below a predetermined level.

3. The apparatus of claim 1 wherein said platform is a swing and said support means moves in the same direction as said swing to actuate said recorded message delivery means.

* * * * *